US009466932B2

(12) United States Patent
Hou et al.

(10) Patent No.: US 9,466,932 B2
(45) Date of Patent: Oct. 11, 2016

(54) ELECTRICAL CONNECTOR AND PLUG-IN MODULE FOR THE SAME

(71) Applicant: DELTA ELECTRONICS (Chen Zhou) CO., LTD., Chen Zhou (CN)

(72) Inventors: Zhixiang Hou, Chen Zhou (CN); Wangjun He, Chen Zhou (CN); Sisi Yang, Chen Zhou (CN); Jung-jui Wang, Chen Zhou (CN)

(73) Assignee: DELTA ELECTRONICS (CHEN ZHOU) CO. LTD. (CN)

( * ) Notice: Subject to any disclaimer, the term of this patent is extended or adjusted under 35 U.S.C. 154(b) by 0 days.

(21) Appl. No.: 14/702,802

(22) Filed: May 4, 2015

(65) Prior Publication Data

US 2016/0049757 A1 Feb. 18, 2016

(30) Foreign Application Priority Data

Aug. 12, 2014 (CN) ..... 2014 2 0453013 U

(51) Int. Cl.
*H01R 24/66* (2011.01)
*H01R 13/66* (2006.01)

(52) U.S. Cl.
CPC ..... *H01R 24/66* (2013.01); *H01R 13/6633* (2013.01)

(58) Field of Classification Search
CPC ... H01R 13/66; H01R 13/6633; H01R 24/66
USPC ..... 439/676, 620.15
See application file for complete search history.

(56) References Cited

U.S. PATENT DOCUMENTS 6,644,984 B2 * 11/2003 Vista, Jr. ..... H01R 9/091 439/76.1
7,153,158 B1 * 12/2006 Lee ..... H01R 13/6658 439/541.5
7,267,584 B1 * 9/2007 Liu ..... H01R 13/6658 439/676
7,485,004 B2 * 2/2009 Liu ..... H01R 12/58 439/620.25
7,611,383 B1 * 11/2009 Huang ..... H01R 13/6658 439/620.17
7,837,511 B2 * 11/2010 Hsu ..... H01R 13/6658 439/490
8,113,882 B1 * 2/2012 Chen ..... H01R 13/6581 439/607.01
8,460,036 B1 * 6/2013 Chen ..... H01R 13/6474 439/660
8,535,100 B2 * 9/2013 Ge ..... H01R 13/6658 439/620.17
8,591,261 B2 * 11/2013 Das ..... H01R 13/6477 439/620.05
2004/0082223 A1 * 4/2004 Hyland ..... H01R 13/6658 439/620.11
2014/0194009 A1 * 7/2014 Zhang ..... H01R 13/514 439/676

FOREIGN PATENT DOCUMENTS

CN 201160177 Y 12/2008

* cited by examiner

*Primary Examiner* — Briggitte R Hammond
(74) *Attorney, Agent, or Firm* — Hauptman Ham, LLP

(57) ABSTRACT

The present disclosure discloses an electrical connector and a plug-in module. The plug-in module includes a base, a plurality of input terminals, a plurality of output terminals and a PCB module. The base includes a bottom plate, a front plate and a back plate, and a tongue plate extending from the bottom plate forward beyond the front plate; the plurality of input terminals are fixed to the back plate, and two ends of each of the input terminals extend respectively beyond a top end of the back plate and a bottom end of the bottom plate; the plurality of output terminals are fixed to the tongue plate and the front plate, and two ends of each of the output terminals extend respectively beyond a top end of the front plate and the tongue plate; and the PCB module includes at least one circuit board.

12 Claims, 8 Drawing Sheets

ELECTRICAL CONNECTOR AND PLUG-IN MODULE FOR THE SAME

CROSS-REFERENCE TO RELATED APPLICATIONS

This application claims priority under 35 U.S.C. §119 to Chinese Patent Application No. 201420453013.X, filed on Aug. 12, 2014, the entire contents of which are incorporated herein by reference.

TECHNICAL FIELD

The present disclosure relates to an electrical connector and a plug-in module for the same, which are mainly used for transmitting data signals of network communication.

BACKGROUND

Electronic devices connected via a network typically require electrical connectors to be connected to the network or other relevant electronic devices.

A conventional electrical connector typically requires an adapter terminal to realize electrical connection between a PCB board and an input terminal or an output terminal, so it has a complicated structure, and requires complicated assembling processes, which leads to a poor network transmission performance.

The above information disclosed in the BACKGROUND is only for a better understanding of the background of the present disclosure, and therefore, it may include information that does not constitute known prior art to those skilled in the art.

SUMMARY

Aspects and advantages of the present disclosure will in part be set forth in the following description, and in part become apparent from the following description, or may be learned from practice of the present disclosure.

According to one aspect of the present disclosure, there is provided a plug-in module, which includes a base, a plurality of input terminals, a plurality of output terminals and a PCB (Printed Circuit Board) module. The base includes a bottom plate of the base, a front plate of the base and a back plate of the base, and a tongue plate extending from the bottom plate of the base forward beyond the front plate of the base; the plurality of input terminals are fixed to the back plate of the base, and two ends of each of the input terminals extend respectively beyond a top end of the back plate of the base and a bottom end of the bottom plate of the base; the plurality of output terminals are fixed to the tongue plate and the front plate of the base, and two ends of each of the output terminals extend respectively beyond a top end of the front plate of the base and the tongue plate; and the PCB module includes at least one circuit board provided at the top ends of the front plate of the base and the back plate of the base and connected to the plurality of input terminals and the plurality of output terminals.

According to another aspect of the present disclosure, there is provided an electrical connector, which includes an insulating body, a housing and a plug-in module. Inside the insulating body there is provided with a module socket along a back to front direction, and provided along a front to back direction with a butt socket connected to the module socket; the housing is provided outside the insulating body; and the plug-in module is inserted into the module socket, the plug-in module being the plug-in module of the present disclosure.

BRIEF DESCRIPTION OF THE DRAWINGS

The above and other features and advantages of the present disclosure will become more apparent from exemplary embodiments described in detail with reference to accompany drawings.

DETAILED DESCRIPTION

Figure 1:
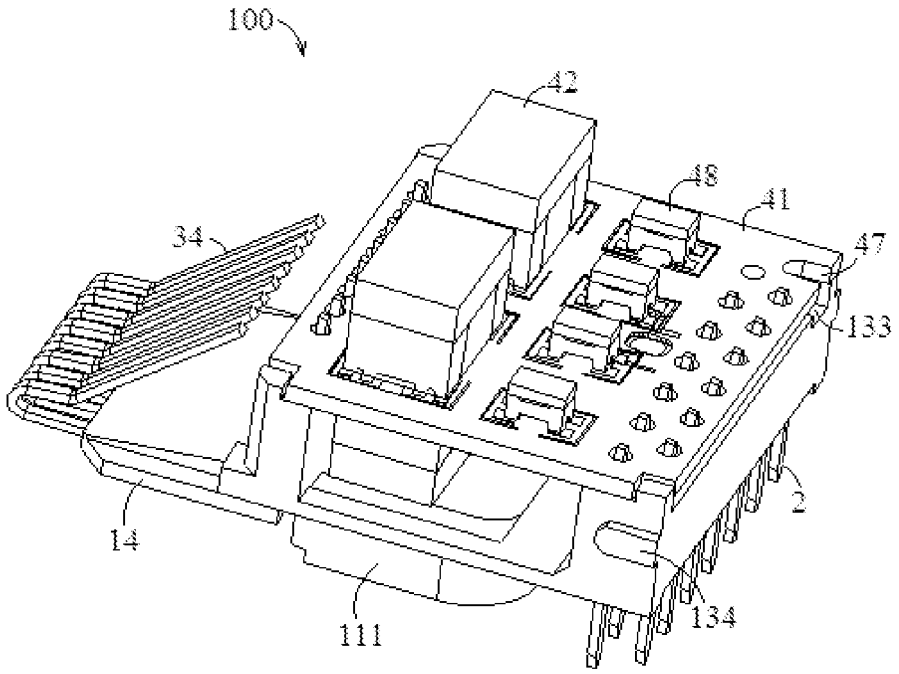
FIG. 1 is a schematic diagram showing a perspective structure of a plug-in module according to an embodiment of the present disclosure.
Figure 2:
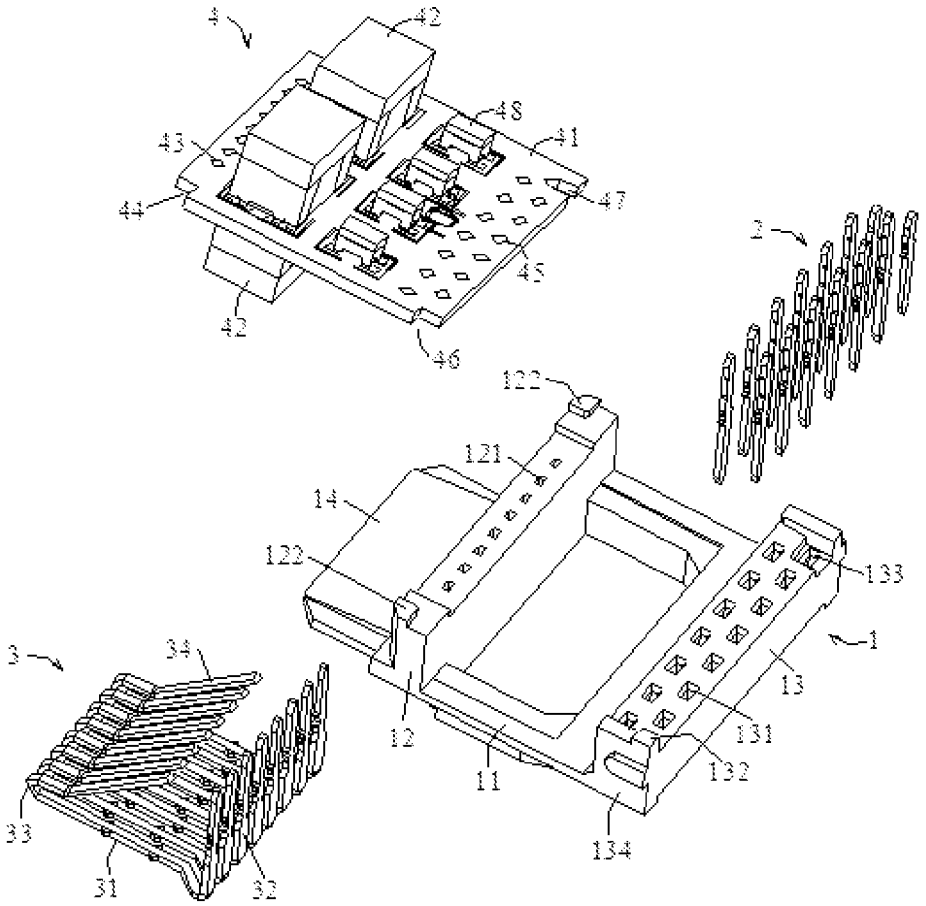
FIG. 2 is a schematic diagram showing an exploded perspective structure of the plug-in module shown in FIG. 1.
Figure 3:
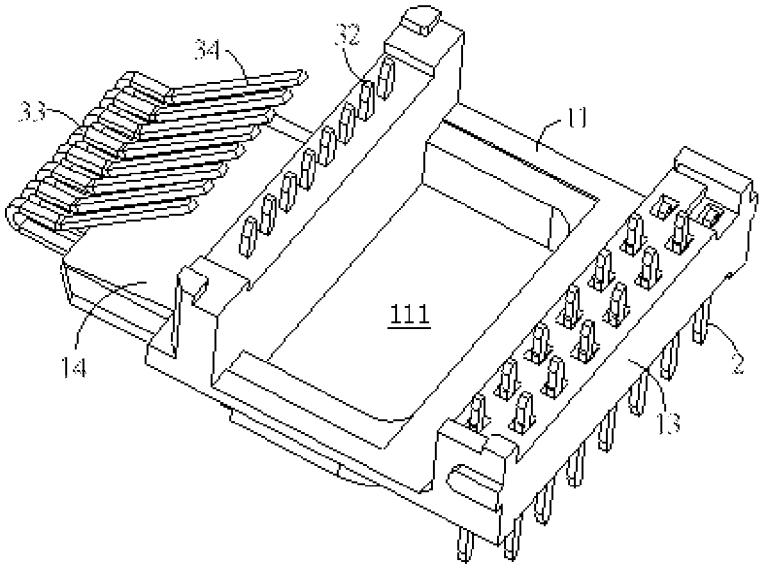
FIG. 3 is a schematic diagram showing a perspective structure of the plug-in module shown in FIG. 1 with input terminals and output terminals connected to a base.
Figure 4:
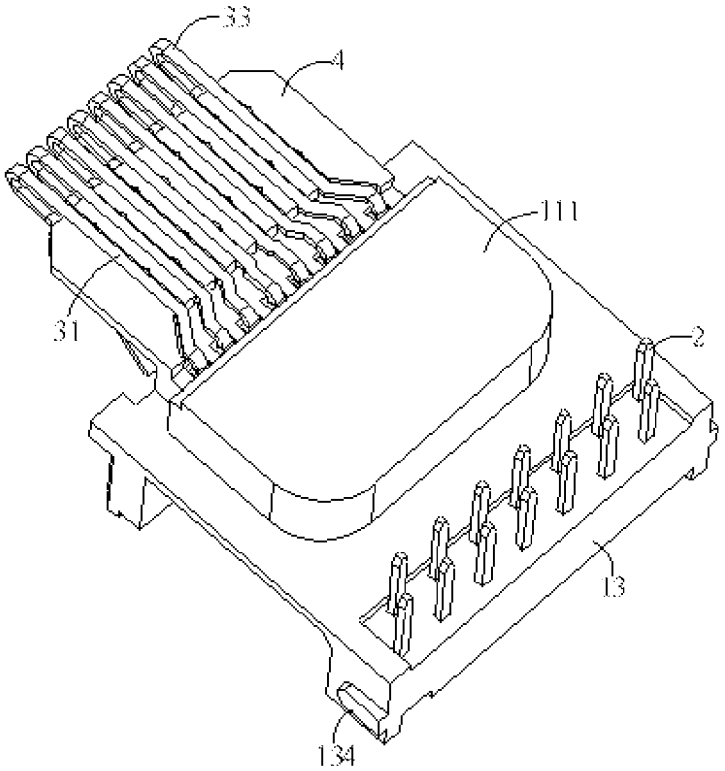
FIG. 4 is a schematic diagram showing another perspective structure of the plug-in module shown in FIG. 1 with input terminals and output terminals connected to a base.

Hereinafter, exemplary embodiments will be described more fully with reference to the accompany drawings. However, the exemplary embodiments may be implemented in many forms, and should not be understood as being limited to the embodiments set forth herein. Instead, these embodiments are provided to make the present disclosure more thorough and complete, and fully covey the concept of the exemplary embodiments to those skilled in the art. In the drawings, same numerals refer to the same or similar structures, hence detailed descriptions thereof will be omitted.

Plug-in Module

Referring to FIGS. 1 to 6, a plug-in module 100 of the present disclosure includes a base 1, a plurality of input terminals 2, a plurality of output terminals 3 and a PCB module 4.

The base 1 includes a bottom plate 11 of the base, a front plate 12 of the base and a back plate 13 of the base positioned on the bottom plate 11 of the base, and a tongue plate 14 extending from the bottom plate 11 of the base forward beyond the front plate 12 of the base. A bottom portion of the tongue plate 14 is provided with a plurality of terminal grooves.

In this embodiment, the front plate 12 of the base and the back plate 13 of the base may be parallel with each other, and both of them may be perpendicular to the bottom plate 11 of the base, but they are not limited thereto, and the front plate 12 of the base and the back plate 13 of the base may also be disposed inclined to the bottom plate 11 of the base, and may be disposed not parallel with each other. The bottom plate 11 of the base may project outward to form an accommodation space 111, but the forming of the accommodation space is not limited thereto. The front plate 12 of the base is provided with a plurality of vertical through holes 121 of the front plate. Each of the two sides of a top portion of the front plate 12 of the base may be respectively formed with a front limit block 122. The back plate 13 of the base is provided with a plurality of vertical through holes 131 of the back plate that may be arranged in two rows of front and back. One side of a top portion of the back plate 13 of the base may be formed with a back limit block 132, and the other side thereof may be provided with a fool-proofing groove 133.

Each of the plurality of input terminals 2 is disposed respectively through a through hole 131 of the back plate 13 of the base, and may be fixed to the through hole 131 of the back plate via a seizure structure of the input terminal 2. An upper end and a lower end of each input terminal 2 respectively projects out of the through hole 131 of the back plate, and at least one-third of a length of the input terminal 2 may locate within the through hole. Therefore, in this embodiment, the input terminals 2 may be fixed very securely to the base 1, and the present disclosure is not limited thereto.

Each of the output terminals 3 may be of an integral structure, including a horizontal fixed portion 31, a vertical fixed portion 32, a bending portion 33 and a contacting portion 34, and the present disclosure is not limited thereto. The input terminals 2 may be used to output signals and the output terminals 3 may be used to input signals, and the present disclosure is not limited thereto.

The horizontal fixed portion 31 is fixed to a terminal groove at a bottom portion of the tongue plate 14. The horizontal fixed portion 31 may be provided with a seizure structure thereon. The vertical fixed portion 32 bends from a back end of the horizontal fixed portion 31 and extends upward. Each of the vertical fixed portion 32 is disposed through a through hole 121 of the front plate 12 of the base, and an upper end of the vertical fixed portion 32 projects out of the through hole 121 of the front plate. The vertical fixed portion 32 may be provided with a seizure structure thereon to increase the holding force. The bending portion 33 bends back from a front end of the horizontal fixed portion 31 and extends backward. The contacting portion 34 bends from the bending portion 33 and inclinedly extends upward.

Figure 5:
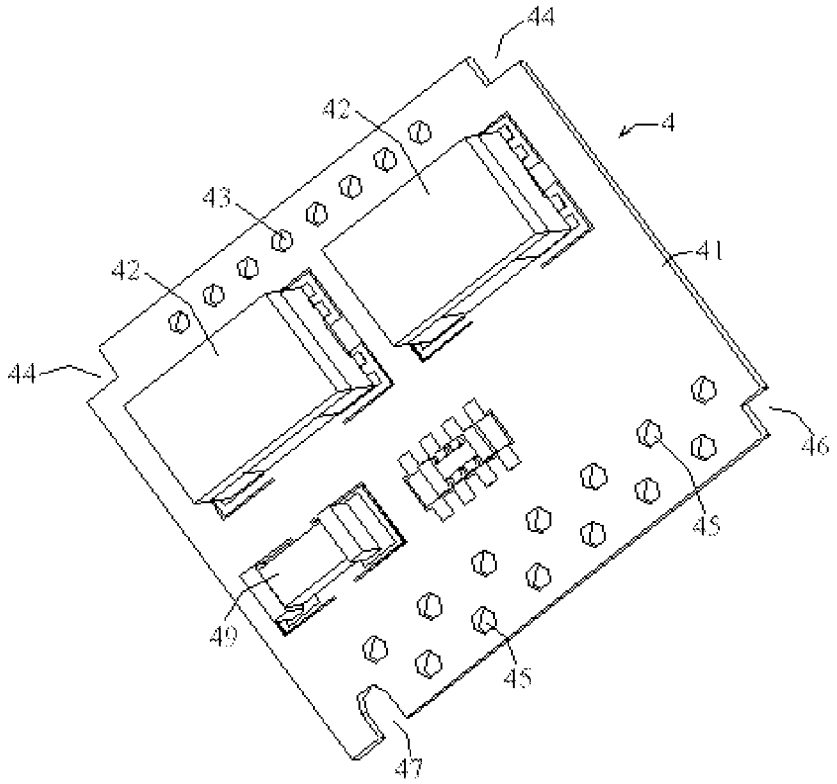
FIG. 5 is a schematic diagram showing a perspective structure of a PCB module of the plug-in module shown in FIG. 1.
Figure 6:
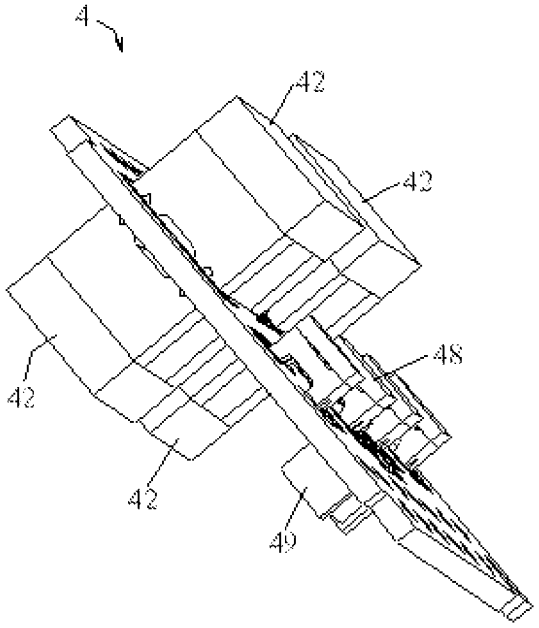
FIG. 6 is a schematic diagram showing another perspective structure of a PCB module of the plug-in module shown in FIG. 1.

Referring to FIGS. 5 and 6, the PCB module 4 includes one or more circuit boards 41. An upper surface and a lower surface of each circuit board 41 may be respectively provided with two patch type transformers 42, but the disclosure is not limited thereto. Further, the upper surface of each circuit board 41 may be provided with a patch type common mode choke coil 48, and the lower surface thereof may be provided with elements such as a resistor 49, etc. In other embodiments, the patch type transformers 42 and the patch type common mode choke coil 48 may also be disposed only at the upper surface or only at the lower surface of the circuit board 41, the numbers thereof may vary, and they may be elements other than the patch type. However, the present disclosure is not limited thereto. The elements provided on the circuit board may be of various forms and types, so as to realize different usages and functions.

The front end of the circuit board 41 is provided with front connection holes 43 corresponding to the through holes 121 of the front plate 12 of the base, and is provided with front notches 44 corresponding to the front limit blocks 122; the back end of the circuit board 41 is provided with back connection holes 45 corresponding to the through holes 131 of the back plate 13 of the base, and is provided with a back notch 46 corresponding to the back limit block 132, and is provided with a fool-proofing opening 47 corresponding to the fool-proofing groove 133.

Electrical Connector

Referring to FIGS. 7 to 11, an electrical connector of an embodiment of the present disclosure includes an insulating body 200, a housing 300 provided outside the insulating body 200, and a plug-in module 100.

Inside the insulating body 200 there is provided with a module socket 50 along a back to front direction, and provided with a butt socket 51 connected to the module socket 50 along a front to back direction. Specifically, the insulating body 200 includes two side walls 52 opposed to each other, a separation wall 53 connected between the two side walls 52, a top wall 54 connected to a top portion of the separation wall 53, and a bottom wall 55 connected between bottom portions of the two side walls 52, but the present disclosure is not limited thereto. There may be a gap between the separation wall 53 and the bottom wall 55, for the tongue plate 14 of the base 1 of the plug-in module 100 to be inserted in. The module socket 50 may be encircled by the two side walls 52, the separation wall 53 and the bottom wall 55, and the butt socket 51 may be encircled by the two side walls 52, the separation wall 53, the top wall 54 and the bottom wall 55.

Figure 10:
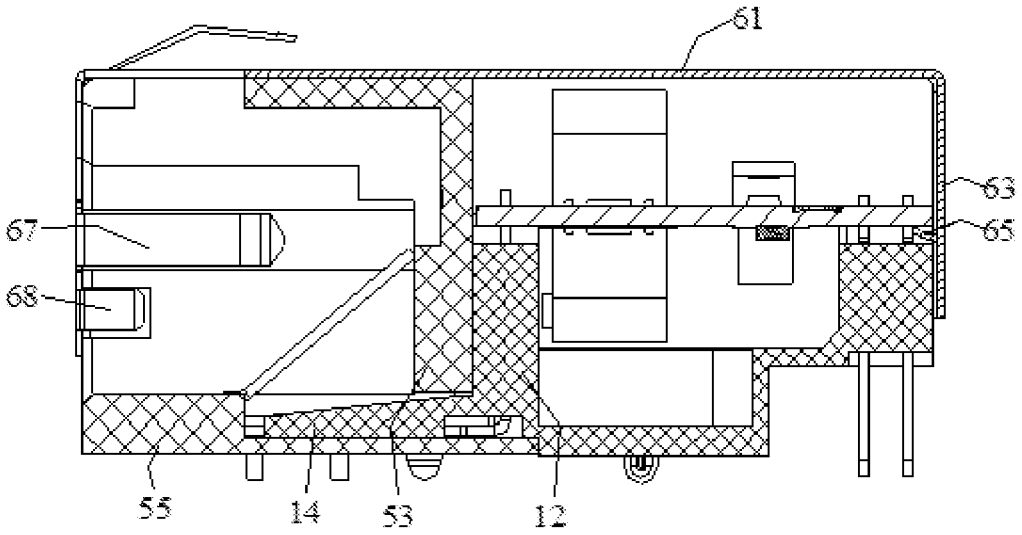
FIG. 10 is a cross sectional view along a line A-A in FIG. 7.
Figure 11:
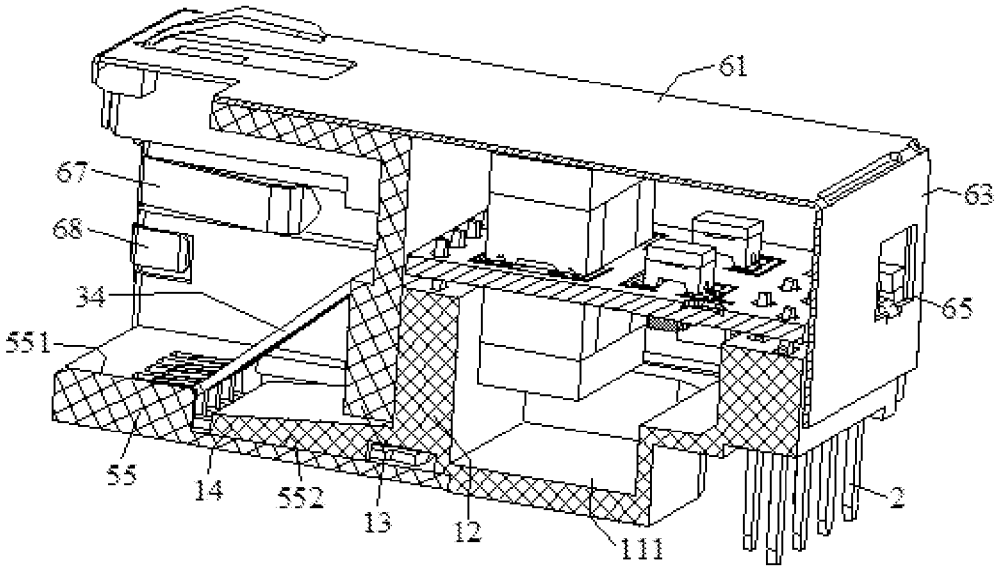
FIG. 11 is a schematic diagram showing a perspective structure cross-sectioned along the line A-A in FIG. 7.

The bottom wall 55 of the insulating body 200 may have a first step surface 551 and a second step surface 552, and the first step surface 551 (as shown in FIGS. 10 and 11) is higher than the second step surface 552. Further, a difference between the heights thereof may be not less than a thickness of the tongue plate 14 of the base 1 of the plug-in module 100. The first step surface is provided with a plurality of accommodation grooves (as shown in FIG. 11) to accommodate the bending portions 33 of the output terminals 3 of the plug-in module 100.

Figure 8:
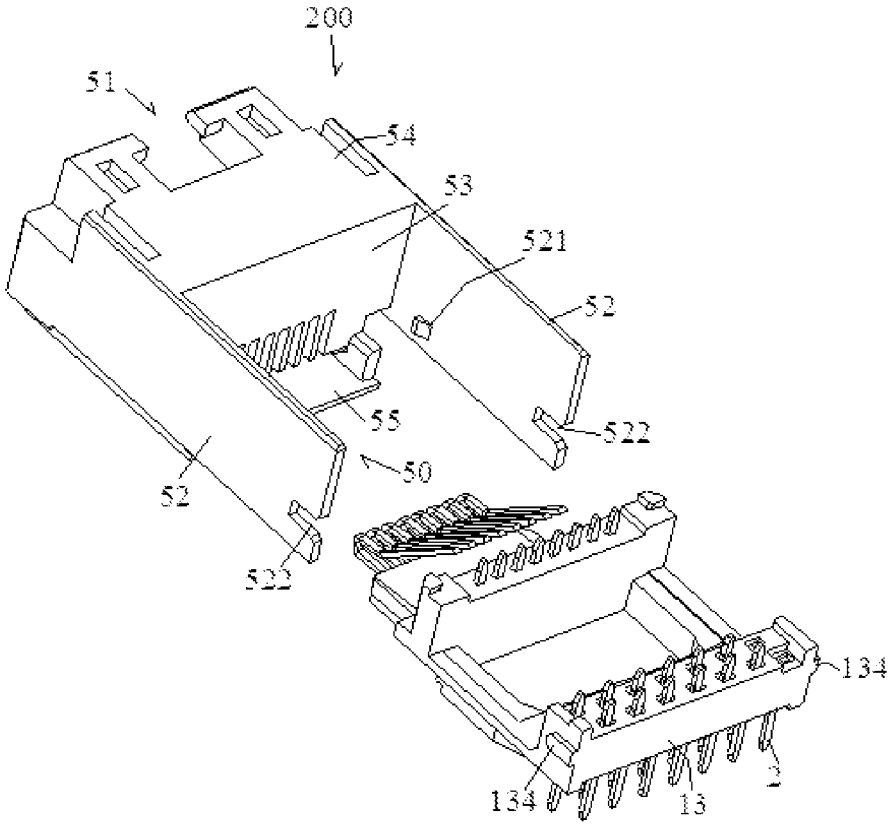
FIG. 8 is a perspective schematic diagram showing a plug-in module and an insulating body in the electrical connector shown in FIG. 7.
Figure 9:
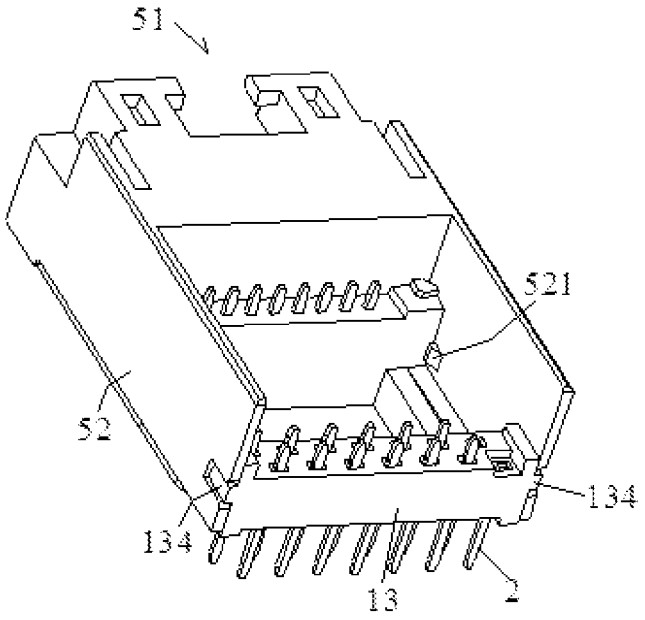
FIG. 9 is a perspective schematic diagram showing the assembled plug-in module and insulating body in the electrical connector shown in FIG. 7, with a PCB module removed.

The insulating body 200 has a resist structure therein, to limit a front and back displacement of the plug-in module 100. Specifically, the resist structure may be a protrusion 521 (as shown in FIG. 8) fixed-inside of each of the two side walls 52. After the plug-in module 100 is assembled to the insulating body 200, the protrusion 521 resists against the front plate 12 of the base of the plug-in module 100 (as shown in FIG. 9), thereby to prevent the plug-in module 100 from moving front and back with respect to the insulating body 200. However, the resist structure is not limited to the protrusion 521 fixed inside of each of the two side walls 52, and may be a resist structure provided at other positions of the insulating body 200, or other types of resist structures, etc.

The insulating body 200 has a first positioning structure, and the plug-in module 100 has a second positioning structure. The first positioning structure may match with the second positioning structure, to limit up and down displacement of the plug-in module 100. Specifically, a gap 522 is provided at a back end of each of the two side walls 52 of the insulating body 200 (as shown in FIG. 8), and a lump 134 is provided at each of the two sides of the back plate 13 of the base 1 of the plug-in module 100. After the plug-in module 100 is assembled to the insulating body 200, the lump 134 and the gap 522 may match with each other (as shown in FIG. 9), so as to prevent the plug-in module 100 from moving up and down with respect to the insulating body 200. However, the first and second positioning structures are not limited to the above mentioned forms of lumps and gaps, and may be other types of position-limiting structures, etc.

The plug-in module 100 may be the plug-in module according to embodiments of the present disclosure, and may be inserted into the module socket 50.

Referring to FIGS. 10 and 11, when the plug-in module 100 is assembled to the insulating body 200 via the module socket 50, the front plate 12 of the base of the plug-in module 100 may be closely attached to the separation wall 53 of the insulating body 200; the tongue plate 14 of the plug-in module 100 may be disposed on the second step surface 552 of the bottom wall 55 of the insulating body 200, and the second step surface 552 may, together with the tongue plate 14, secure the horizontal fixed portions 31 of the output terminals 3; the bending portions 33 of the output terminals 3 are disposed in the accommodation grooves below the first step surface 551, but the disclosure is not limited thereto. The protrusion 521 of the insulating body 200 may resist against a back surface of the front plate 12 of the base of the plug-in module 100, and the lump 134 of the plug-in module 100 may be stuck inside the gap 522 of the insulating body 200.

Figure 7:
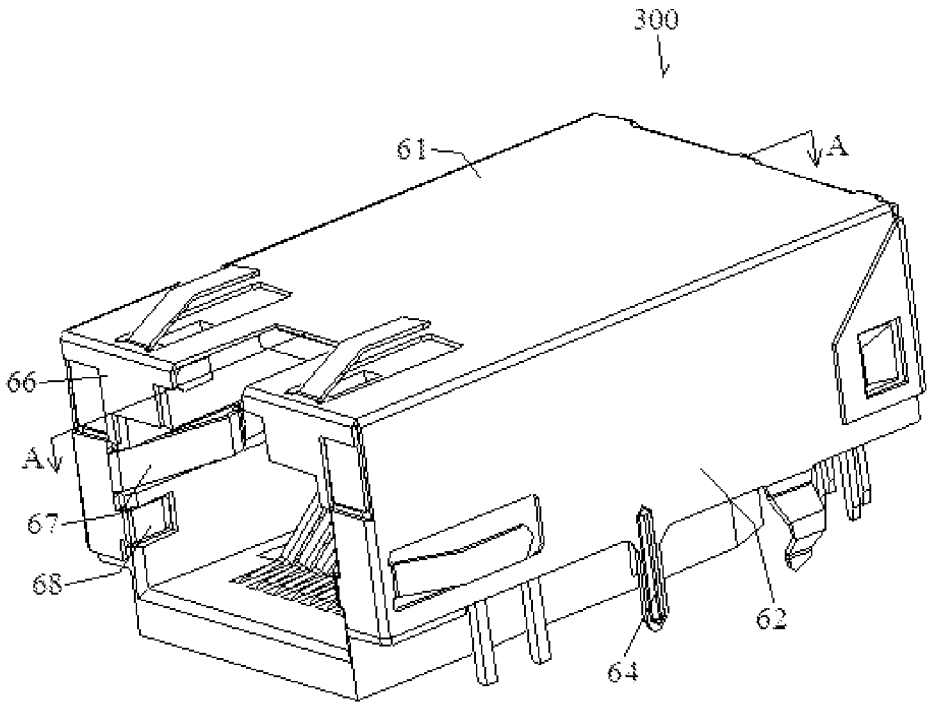
FIG. 7 is a schematic diagram showing a perspective structure of an electrical connector according to an embodiment of the present disclosure.

Referring to FIGS. 7, 10 and 11, the housing 300 includes a top wall 61 of the housing, two side walls 62 of the housing, a back wall 63 of the housing, and a front wall 66 of the housing. The front wall 66 of the housing is provided with a window corresponding to the butt socket 51 of the insulating body 200. A grounding pin 64 is connected with the housing 300, for example, one of the side walls 62 of the housing.

The back wall 63 of the housing is provided with a welding portion 65. The welding portion 65 may be a structure integrated with the housing, or may be a structure not integrated with the housing. The welding portion 65 may be electrically connected to a grounded welding portion (not shown in the drawings) of the circuit board 41, such as a grounded welding hole, thereby to realize grounding of the circuit board 41 via the welding portion 65. The welding portion 65 is not necessarily provided on the back wall 63 of the housing, and may be provided at other positions of the housing 300. For example, the welding portion 65 may be provided in proximity to the circuit board 41, so as to facilitate the connection with the circuit board 41.

Figure 12:
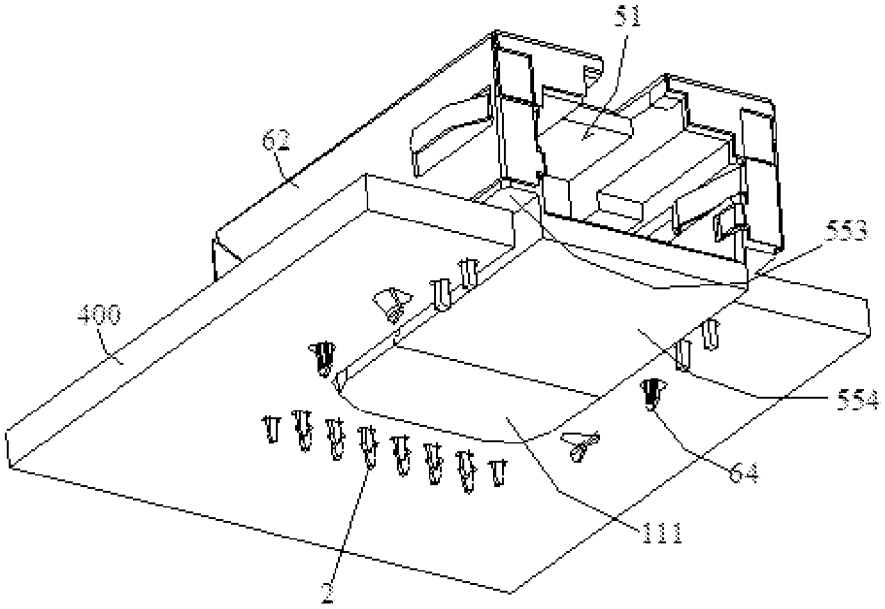
FIG. 12 is a schematic diagram showing a perspective structure of the electrical connector shown in FIG. 7 assembled with a customer circuit board.
Figure 13:
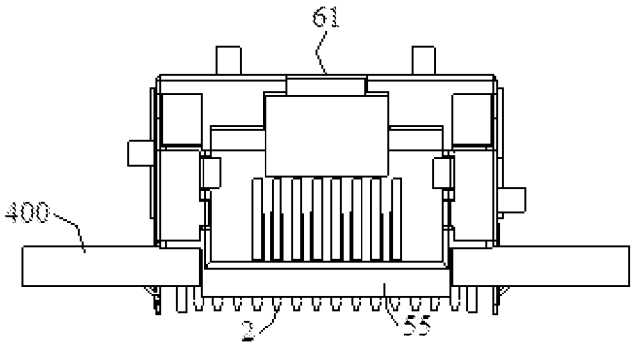
FIG. 13 is a front view of FIG. 12.

The front wall 66 of the housing 300 is provided with a first seizure arm 67 extending backward. A back end of the first seizure arm 67 is formed with a seizure portion, and the seizure portion may have elasticity, but the present disclosure is not limited thereto. A side wall of the butt socket of the insulating body 200 may be provided with a seizure groove corresponding to the first seizure arm 67. In this embodiment, when a plug is inserted into the butt socket 51, the seizure portion may be subjected to a pressure toward the seizure groove exerted by the plug, and the elasticity of the seizure portion may facilitate fixing the plug. The front wall 66 of the housing 300 may be provided with a second seizure arm 68 bending and extending backward, and a side wall of the butt socket of the insulating body 200 may be provided with a seizure groove to be matched with the second seizure arm 68. A front end of the housing 300 may be fixed to the insulating body 200 via the second seizure arm 68, as shown in FIGS. 12 and 13. In the electrical connector of one embodiment, the insulating body 200 has a bottom wall 55, and each of the two sides of the outside of the bottom wall 55 may respectively form a third step surface 553, which may be higher than an outside surface 554 of the bottom wall 55, thereby to form a groove. When the electrical connector is applied to a customer circuit board 400 having hollow-out parts to be assembled, the customer circuit board 400 may be matched to the groove, thereby a total height of the customer circuit board 400 and the electrical connector may be effectively reduced, so as to advantageously reduce the volume of the electronic device.

The exemplary embodiments of the present disclosure are specifically illustrated and described as above. It should be understood that the present disclosure is not limited to the disclosed embodiments. Rather, the present disclosure intends to cover various modifications and equivalent arrangements falling within the spirit and scope of the appended claims.

What is claimed is:

1. An electrical connector, comprising:

an insulating body, providing inside the insulating body with a module socket along a back to front direction, and providing inside the insulating body along a front to back direction with a butt socket connected to the module socket;

a housing, provided outside the insulating body; and a plug-in module, inserted into the module socket, wherein, the housing is provided with a welding portion, the welding portion being electrically connected to a grounded welding portion of the circuit board, wherein the welding portion extends inward from the housing, and wherein the plug-in module comprises:

a base, comprising a bottom plate of the base, a front plate of the base and a back plate of the base, and a tongue plate extending from the bottom plate of the base forward beyond the front plate of the base;

a plurality of input terminals, fixed to the back plate of the base, and two ends of each of the input terminals extending respectively beyond a top end of the back plate of the base and a bottom end of the bottom plate of the base;

a plurality of output terminals, fixed to the tongue plate and the front plate of the base, and two ends of each of the output terminals extending respectively beyond a top end of the front plate of the base and the tongue plate; and a PCB module, comprising at least one circuit board provided at the top ends of the front plate of the base and the back plate of the base and connected to the plurality of input terminals and the plurality of output terminals.

2. The electrical connector according to claim 1, wherein, the back plate of the base is provided with a plurality of through holes of the back plate, each of the input terminals is provided through corresponding one of the through holes of the back plate, and at least one-third of a length of the input terminal is located within the through hole of the back plate.

3. The electrical connector according to claim 1, wherein, each of the output terminals comprises:

a horizontal fixed portion, fixed to a terminal groove at a bottom portion of the tongue plate;

a vertical fixed portion, bending from a back end of the horizontal fixed portion and extending upward, the vertical fixed portion being fixed to the front plate of the base;

a bending portion, bending back from a front end of the horizontal fixed portion and extending backward; and a contacting portion, bending from the bending portion and inclinedly extending upward.

4. The electrical connector according to claim 3, wherein, the front plate of the base is provided with a plurality of through holes of the front plate, the vertical fixed portion is provided through corresponding one of the through holes of the front plate, and at least one-third of a length of the vertical fixed portion is located within the through hole of the front plate.

5. The electrical connector according to claim 1, wherein, an upper surface and/or a lower surface of the circuit board is provided with at least one patch type transformer and/or at least one patch type common mode choke coil.

6. An electrical connector, comprising:

an insulating body, providing inside the insulating body with a module socket along a back to front direction, and providing inside the insulating body along a front to back direction with a butt socket connected to the module socket;

a housing, provided outside the insulating body; and a plug-in module, inserted into the module socket, wherein the insulating body has a resist structure therein, and the resist structure contains a resist protrusion, configured to resist against the front plate of the base of the plug-in module, and wherein the plug in module comprises:

a base, comprising a bottom plate of the base, a front plate of the base and a back plate of the base, and a tongue plate extending from the bottom plate of the base forward beyond the front plate of the base;

a plurality of input terminals, fixed to the back plate of the base, and two ends of each of the input terminals extending respectively beyond a top end of the back plate of the base and a bottom end of the bottom plate of the base;

a plurality of output terminals, fixed to the tongue plate and the front plate of the base, and two ends of each of the output terminals extending respectively beyond a top end of the front plate of the base and the tongue plate; and a PCB module, comprising at least one circuit board provided at the top ends of the front plate of the base and the back plate of the base and connected to the plurality of input terminals and the plurality of output terminals.

7. The electrical connector according to claim 6, wherein, the housing is provided with a welding portion, the welding portion being electrically connected to a grounded welding portion of the circuit board.

8. The electrical connector according to claim 6, wherein, a front end of the housing is provided with at least one seizure arm extending backward, a back end of the seizure arm is provided with a seizure portion, and a side wall of the butt socket is provided with a seizure groove matched with the seizure arm.

9. The electrical connector according to claim 6, wherein, the insulating body has a bottom wall, a step surface is formed on each of two sides of the bottom wall, and the step surface is higher than a bottom surface of the bottom wall.

10. The electrical connector according to claim 6, wherein, the insulating body has a first positioning structure containing a gap or a lump, the plug-in module has a second positioning structure containing a lump or a gap, and the first positioning structure is matched with the second positioning structure.

11. The electrical connector according to claim 6, wherein, the resist protrusion is positioned at an inner side of a side wall of the insulating body.

12. The electrical connector according to claim 1, wherein the front plate of the base and the back plate of the base are parallel with each other and are perpendicular to the bottom plate of the base, and the bottom plate of the base projects outward to form an accommodation space.

* * * * *